US008689744B2

(12) United States Patent
Chae et al.

(10) Patent No.: US 8,689,744 B2
(45) Date of Patent: Apr. 8, 2014

(54) COOLING DEVICE AND INSERT FOR WATER JACKET OF INTERNAL COMBUSTION ENGINE

(75) Inventors: Dongsuk Chae, Seoul (KR); Kwangsik Yang, Hwaseong-si (KR); Taewon Park, Hwaseong-si (KR); Wootae Kim, Suwon-si (KR); Sanghee Lee, Hwaseong-si (KR); Jaeheon Lee, Yongin-si (KR); Changseok Oh, Seongnam-si (KR); Kiwoong Song, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 1125 days.

(21) Appl. No.: 12/507,392

(22) Filed: Jul. 22, 2009

(65) Prior Publication Data

US 2010/0024748 A1 Feb. 4, 2010

(30) Foreign Application Priority Data

Aug. 4, 2008 (KR) ..... 10-2008-0075947
Apr. 7, 2009 (KR) ..... 10-2009-0029914

(51) Int. Cl.
*F02F 1/14* (2006.01)

(52) U.S. Cl.
USPC ..... 123/41.79

(58) Field of Classification Search
USPC ..... 123/41.72, 41.79, 41.82 R, 193.1–193.6, 123/195 R
See application file for complete search history.

(56) References Cited

U.S. PATENT DOCUMENTS

| | | | | |
|---|---|---|---|---|
| 4,554,893 | A * | 11/1985 | Vecellio | 123/41.83 |
| 5,669,339 | A * | 9/1997 | Yukawa et al. | 123/41.79 |
| 8,091,518 | B2 * | 1/2012 | Shikida et al. | 123/41.74 |

FOREIGN PATENT DOCUMENTS

| | | | | |
|---|---|---|---|---|
| JP | 6-241111 | A | 8/1994 | |
| JP | 2002-030989 | A | 1/2002 | |
| JP | 2005-002800 | A | 1/2005 | |
| JP | 2005-120944 | A | 5/2005 | |
| JP | 2007-127066 | A | 5/2007 | |
| JP | 2008-014263 | A | 1/2008 | |
| JP | 2008-031939 | A | 2/2008 | |
| KR | 10-2010-0015060 | A | 2/2010 | |
| WO | WO 2008/010584 | A1 | 1/2008 | |
| WO | WO 2008016127 | A1 * | 2/2008 | F02F 1/14 |

OTHER PUBLICATIONS

Office Action dated May 23, 2013, in Chinese Patent Application No. 200910161697.X (Chinese and English translation therefor).

* cited by examiner

*Primary Examiner* — Hung Q Nguyen
(74) *Attorney, Agent, or Firm* — Morgan, Lewis & Bockius LLP

(57) ABSTRACT

The present invention is provided with one or more inserts that are inserted at the lower portion of a water jacket formed at siamese portions between cylinder bores of a cylinder block and increase the flow of cooling water at the upper portion of the water jacket, in order to provide a cooling device and an insert for a water jacket of an internal combustion engine, which is inserted at the lower portion of the water jacket formed at the siamese portions of the cylinder block to increase the flow of cooling water, improves cooling efficiency of the siamese portions of the cylinder block by inducting recirculation of the cooling water at the lower portion, and improves fuel efficiency by making the temperature uniform in the stroke direction of the piston of the cylinder block and reducing friction of the piston.

17 Claims, 13 Drawing Sheets

COOLING DEVICE AND INSERT FOR WATER JACKET OF INTERNAL COMBUSTION ENGINE

CROSS-REFERENCE TO RELATED APPLICATIONS

The present application is based on, and claims priority from, Korean Application Numbers 10-2008-0075947 and 10-2009-0029914, filed on Aug. 4, 2008 and Apr. 7, 2009, the disclosure of which are hereby incorporated by reference herein in its entirety.

FIELD OF THE INVENTION

The present invention relates to a cooling device and an insert for a water jacket of an internal combustion engine, particularly a cooling device and an insert for a water jacket of an internal combustion engine that improve cooling efficiency of the internal combustion engine by increasing the flow of cooling water around the siamese portion of a cylinder block.

BACKGROUND OF THE INVENTION

A siamese cylinder block with small gaps (bore pitches) between cylinders is used in multi-cylinder engines of vehicle in the related art to reduce the size, weight, and entire length. The siamese cylinder bock is manufactured by casting aluminum with several cylinder liners, in which the pitches of the cylinder bores are formed short by removing water jackets (cooling water channels) between the cylinder liners.

In the siamese cylinder block having the above structure, the gaps between the cylinder bores (referred to as 'siamese portion') are small and it is difficult to form cooling water channels, such that it is vulnerable to heat. In particular, the siamese portion around the upper end of the cylinder block where heat is directly transferred from the combustion chamber is heated at considerably high temperature.

When the siamese portion is heated at high temperature, temperature difference from the surroundings occurs and the upper portion of the cylinder block is excessively deformed by heat, which deteriorates the degree of perfect circle of the cylinder bore. Further, the engine oil flows inside the combustion chamber through the gap between the piston ring and the inner wall of the cylinder block, such that the engine oil is wasted and blow-by gas increases. Accordingly, cooling the upper portion of the cylinder block and the siamese portion is very important to ensure sealability against the combustion gas, prevent the bores from being excessively deformed, and reduce the temperature of the pistons.

Researches for appropriately cooling the siamese portion by forming silts or drill holes, which function as cooling water channels, between the cylinder bores or forming a wedge-shaped water hole through the cylinder head gasket have been conducted in the related art; however, the cooling effect was insufficient.

SUMMARY OF THE INVENTION

Embodiments of the present invention help overcome the drawbacks in the related art and it is an object of the invention to provide a cooling device and an insert for a water jacket of an internal combustion engine that improves cooling efficiency of siamese portions of a cylinder block by increasing the flow of cooling water in the water jacket formed at the siamese portions, and improves fuel efficiency by making the temperature uniform in the stroke direction of the piston of the cylinder block and reducing friction of the piston.

In order to achieve the object of the present invention, a cooling device for an internal combustion engine includes one or more inserts that are inserted at the lower portion of a water jacket formed at a siamese portion between the cylinder bores of a cylinder block and increases the flow of cooling water at the upper portion of the water jacket.

Further, a cooling device for an internal combustion engine according to the present invention includes one or more inserts that are inserted at the lower portion of a water jacket formed at a siamese portion between the cylinder bores of a cylinder block and increases the flow of cooling water at the upper portion and the lower portion of the water jacket.

Further, in an insert for a water jacket of an internal combustion engine according to the present invention, two triangular wings are symmetrically and integrally connected by a connecting portion of the center and each of the wings is bent in an arch shape that is the same as the lower shape of a water jacket formed in a shape surrounding the cylinder of a cylinder block.

According to an insert for a water jacket of an internal combustion engine according to the present invention, since the triangular inserts having a shape similar to the water jacket are inserted at the lower portion of the water jacket formed at the siamese portions, when cooling water flows along the water jacket, the flow is increased at the upper portion of the water jacket and the flow velocity is increased by the inserts. Accordingly, cooling effect increases at the upper portion of the cylinder block and the siamese portions and cooling effective can be improved at a predetermined level at the center portion and the lower portion of the cylinder block by recirculation of the cooling water. Further, a temperature difference is reduced in the stroke direction of the piston of the cylinder block, such that it is possible to maintain the degree of perfect circle of the cylinder bore and reduce consumption of the engine oil and the blow-by gas by reducing friction of the piston while improving fuel efficiency. In addition, it is more effective to apply the insert to a cylinder block that does not undergo heat treatment and is vulnerable to deformation of the cylinder bore.

Further, according to an insert for a water jacket of an internal combustion engine according to the present invention, when the cooling water flows along the water jacket, the flow is increased not only at the upper portion, but the lower portion of the water jacket and the flow velocity is increased by the insert, such that it is possible to effectively cool the engine oil scattered and sticking to the surface of the cylinder block that forms the lower portion of the water jacket. Accordingly, it is possible to prevent the engine oil from being deteriorated, which reduces necessity of additionally providing an oil cooler or increase the capacity.

BRIEF DESCRIPTION OF THE DRAWINGS

For better understanding of the nature and objects of the present invention, reference should be made to the following detailed description with the accompanying drawings, in which.

DETAILED DESCRIPTION OF THE PREFERRED EMBODIMENTS

The present invention is described hereafter in detail with reference to the accompanying drawings.

Figure 1:
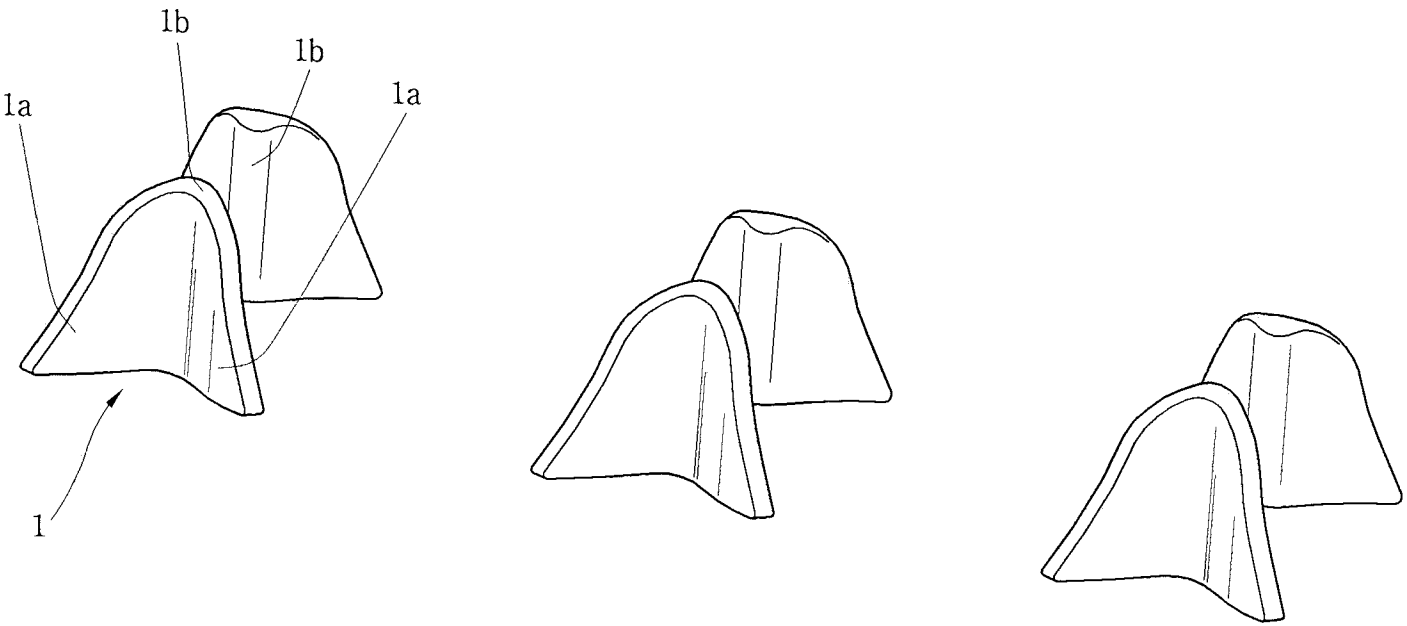
FIG. 1 is a perspective view of inserts for a water jacket of an internal combustion engine according to an embodiment of the present invention.

FIG. 1 shows a perspective view of inserts 1 for a water jacket of an internal combustion engine according to an embodiment of the present invention, in which two triangular wings 1*a* are integrally connected by a connecting portion 1*b* at the center.

The wing 1*a* is bent in an arc shape, which is the same as the shape of a water jacket formed to surround a cylinder, and the left and right wings are formed symmetrically with connecting portion 1*b* therebetween.

It is preferable that wings 1*a* and connecting portion 1*b* are formed by injection-molding a plastic material.

Figure 2:
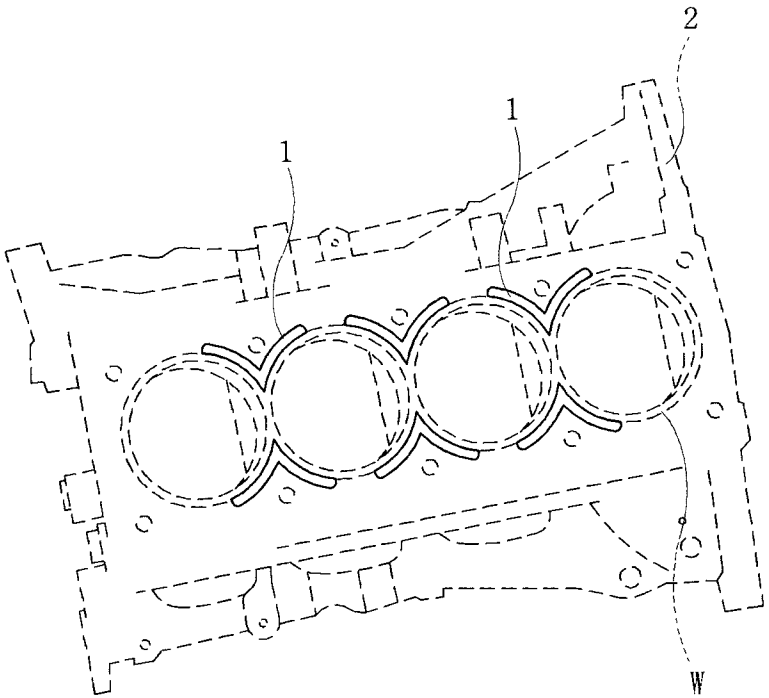
FIG. 2 is a view illustrating that the inserts for a water jacket of an internal combustion engine according to the present invention are disposed in a cylinder block.
Figure 2:
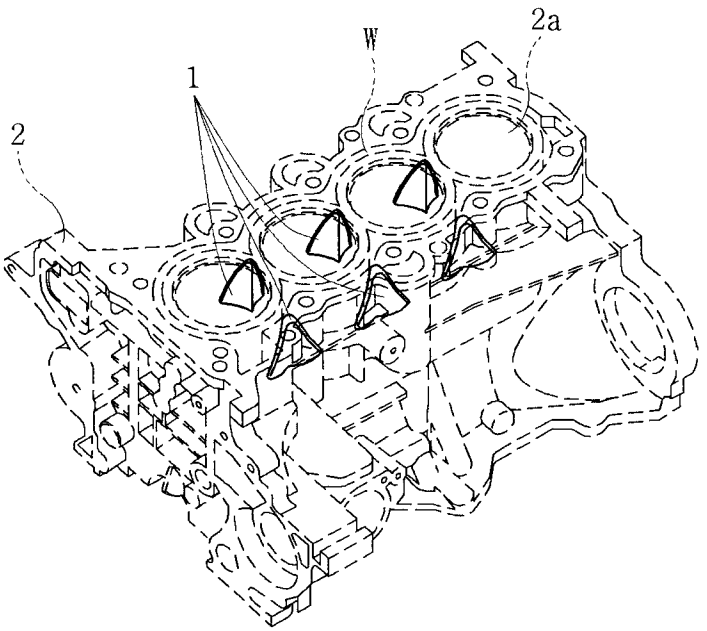

FIG. 2 shows that inserts 1, which were manufactured as described above according to the present invention, are disposed in a cylinder block. A water jacket W surrounding the outer circumference of the cylinders of cylinder block 2 is formed to have a predetermined depth and inserts 1 are inserted at the lower portion of water jacket W.

Inserts 1 make pairs and each pair of inserts 1 is disposed to face each other and inserted at the lower portion of the water jacket formed at the siamese portions between the cylinders.

In a combustion engine equipped with four cylinders, inserts 1 are disposed between the first cylinder and the second cylinder, the second cylinder and the third cylinder, and the third cylinder and the fourth cylinder, such that total six inserts are provided.

Figure 3:
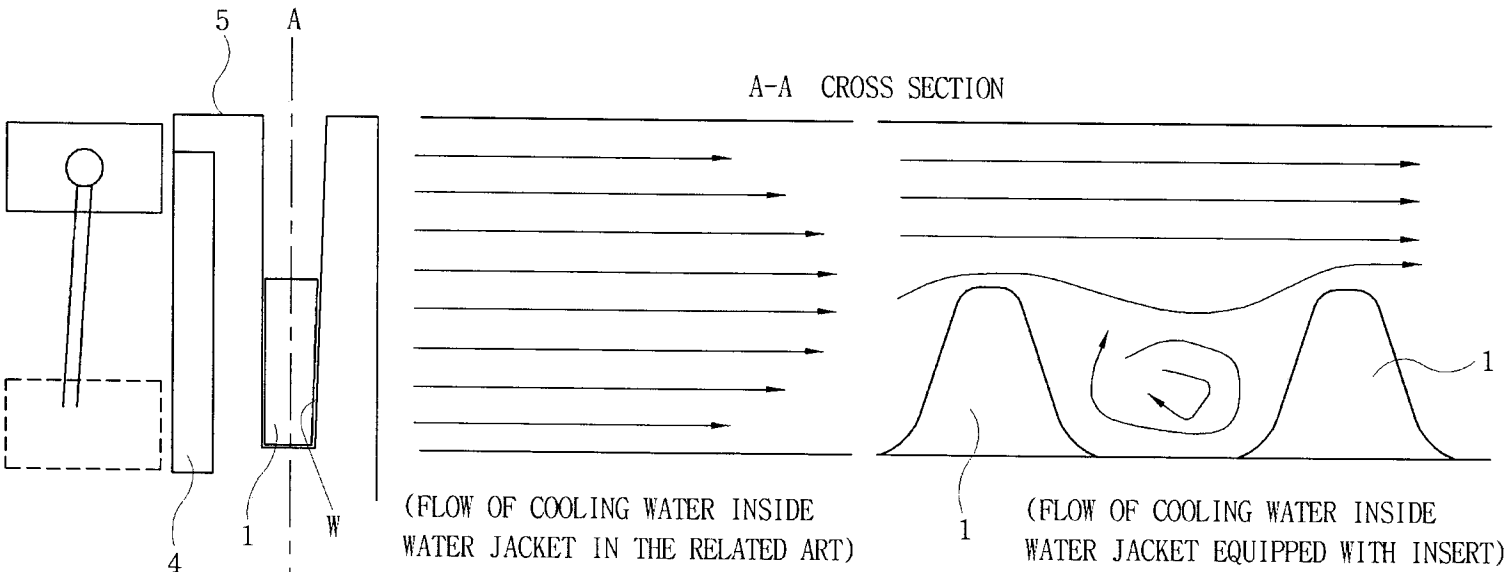
FIG. 3 is a view comparing the flow of cooling water when the inserts for a water jacket of an internal combustion engine according to the present invention are disposed with the related art.

FIG. 3 is a view comparing the flow state of cooling water, which flows along the water jacket with the inserts according to the present invention disposed at the lower portion of the water jacket, with the related art. Water jacket W is formed to have a predetermined depth at the siamese portion 5 adjacent to a cylinder liner 4 and insert 1 according to the present invention are inserted at the lower portion of water jacket W. Since insert 1 is formed in the same shape as the water jacket, when the insert is inserted at the lower portion of the water jacket, it is positioned in place by the own weight. Further, since the insert is bent in an arc shape, it is fixed to the cylinder block in axial direction of the crankshaft, such that it does not need to use a specific fixing device.

The flow velocity of cooling water is the smallest at the upper portion and the lower portion of the water jacket and the largest at the center portion before the insert according to the present invention is inserted, whereas when insert 1 is inserted, the insert 1 interferes with the flow of the cooling water and the flow cross section is reduced, such that the flow velocity at the upper portion of the water jacket correspondingly increases.

The cooling water recirculates at the center portion and the lower portion of the water jacket between two inserts 1 and a predetermined level of cooling effect is achieved.

Figure 4:
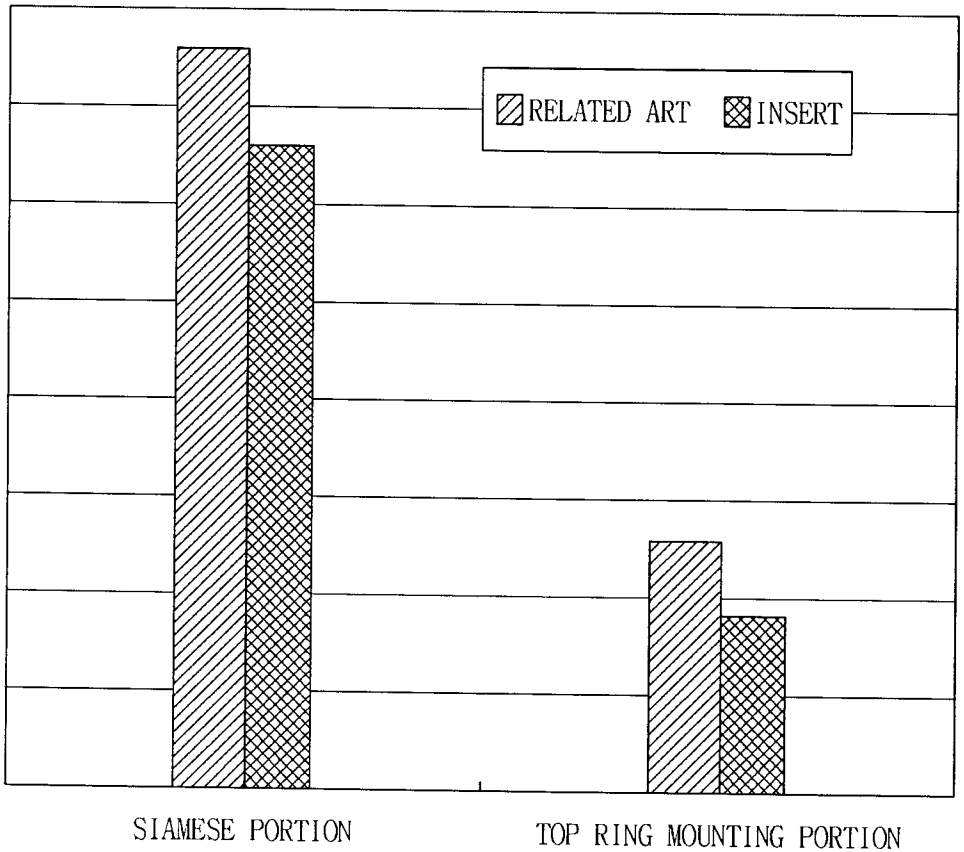
FIG. 4 is a view comparing temperature of a siamese portion and a top ring mounting portion when the inserts for a water jacket of an internal combustion engine according to the present invention are disposed with the related art.

FIG. 4 is a view comparing temperature of the siamese portion and the top ring mounting portion when the inserts according to the present invention are disposed with when the inserts are not disposed in the related art. As the flow of cooling water is increased at the upper portion of the cylinder block by the inserts, the cooling effect increases at the siamese portion and the top ring mounting portion, such that the temperature of the cylinder block is reduced.

Figure 5:
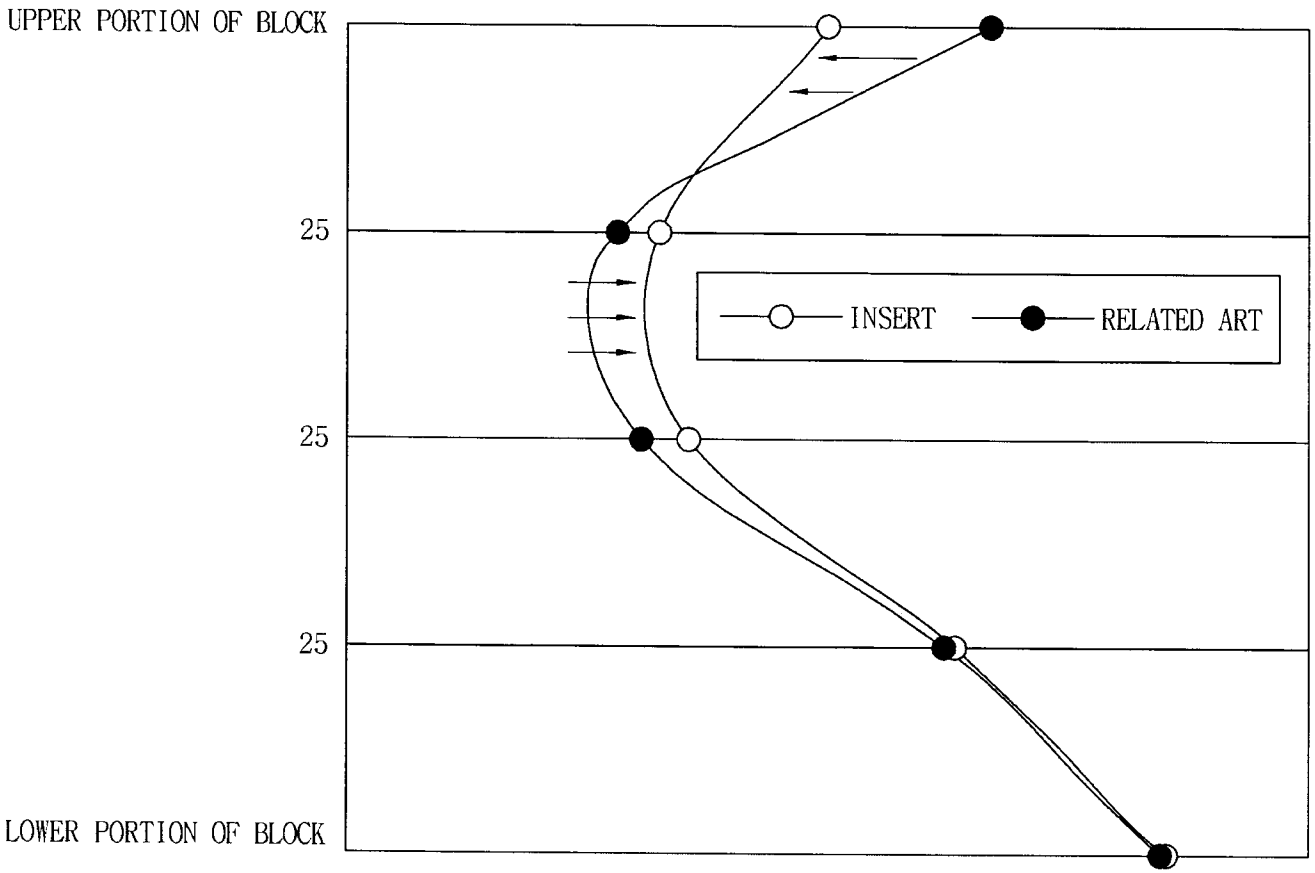
FIG. 5 is a view comparing temperature difference in the stroke direction of the piston of the cylinder block when the inserts for a water jacket of an internal combustion engine according to the present invention are disposed with the related art.

FIG. 5 is a view comparing temperatures in the stroke direction of the piston of the cylinder block when the inserts are disposed and when the insert are not disposed. The flow of cooling water increases at the upper portion of the cylinder block when the inserts are disposed in the water jacket of the cylinder block, whereas the flow velocity of cooling water decreases at the center portion and the lower portion of the cylinder block, such that the temperature difference in the stroke direction of the cylinder block is reduced.

Further, as the temperature is reduced at the upper portion of the cylinder block, friction between the piston and the cylinder block is reduced and the fuel efficiency increases. Furthermore, as deformation of the cylinder bore is reduced, the consumption amount of engine oil, the blow-by gas, and the operation noise of the piston are reduced.

However, in the above embodiment, the flow of cooling water increases at the upper portion of the water jacket and the upper portion of the cylinder block is effectively cooled, whereas the flow is a little poor at the lower portion of the water jacket, such that it is difficult to cool the engine oil scattered and sticking to the surface of the cylinder block, which forms the lower portion of the water jacket. Accordingly, the engine oil may be deteriorated, and it may be required to additionally provide an oil cooler or increase the capacity to prevent the deterioration.

Therefore, embodiments that make it easy to cool the engine oil sticking to the surface of the cylinder block, which forms the lower portion of the water jacket, by removing the above defects while ensuring an appropriate level of flow at the lower portion of the water jacket are proposed as follows.

Figure 6:
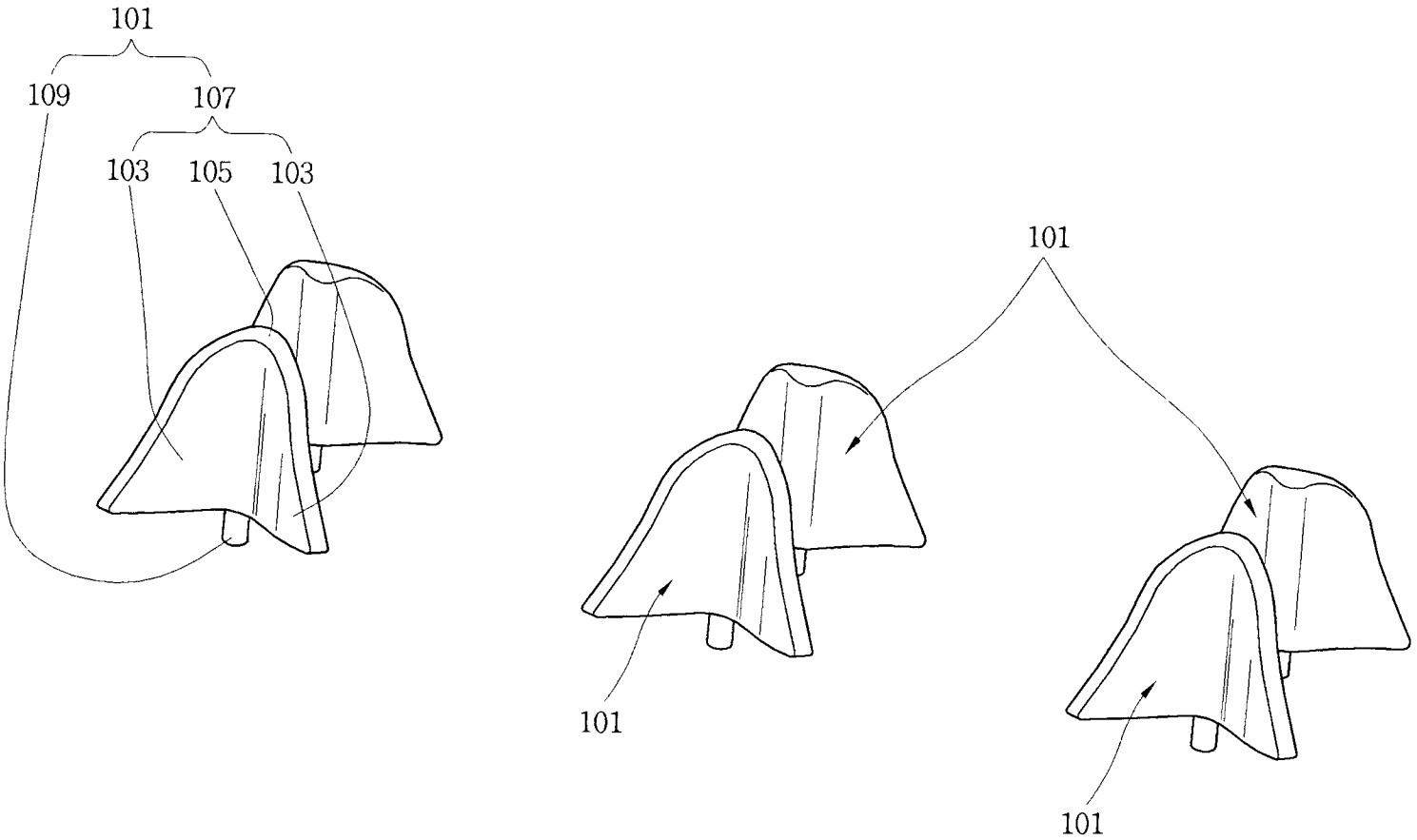
FIG. 6 is a perspective view of inserts for a water jacket of an internal combustion engine according to another embodiment of the present invention.
Figure 7:
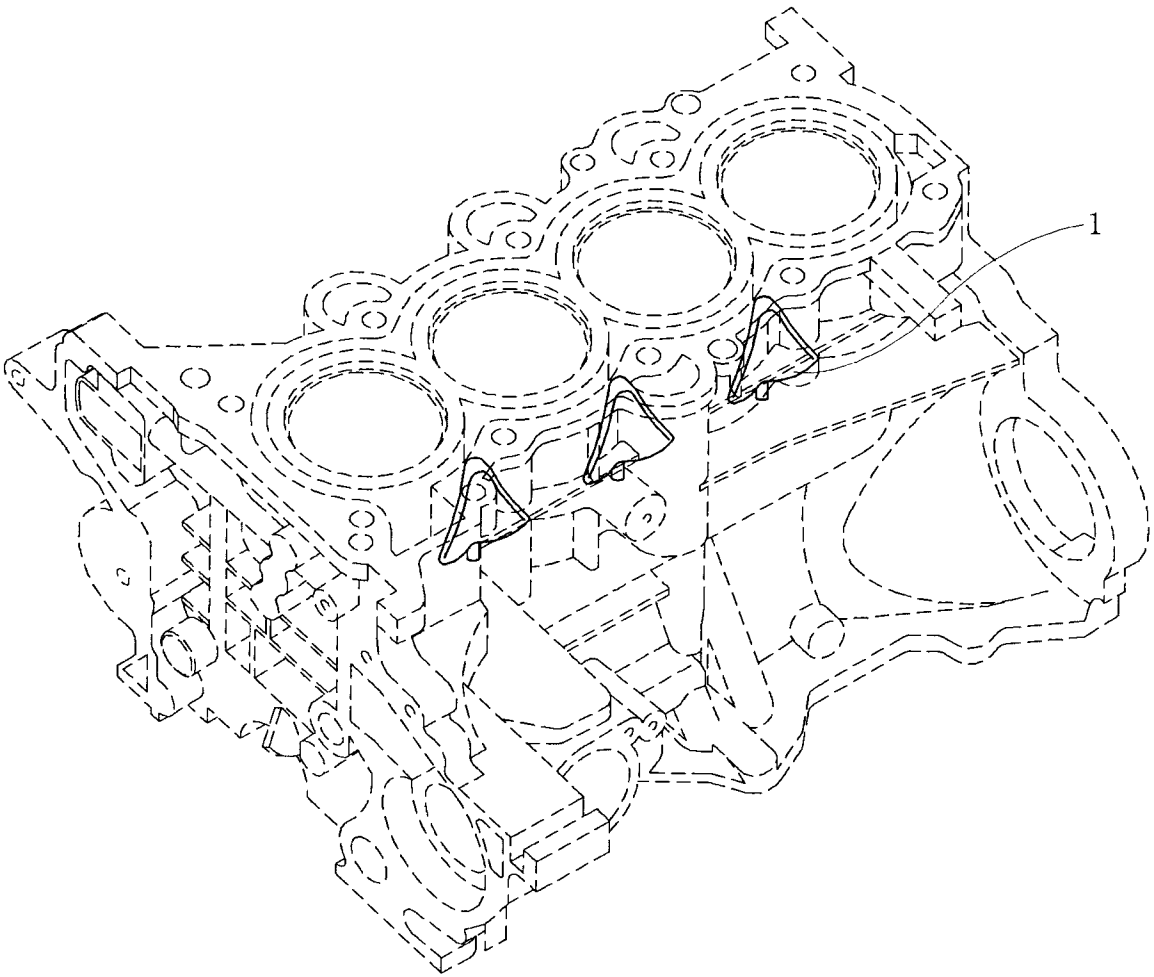
FIG. 7 is a view illustrating that the inserts for a water jacket of an internal combustion engine of FIG. 6 are disposed in a cylinder block.
Figure 8:
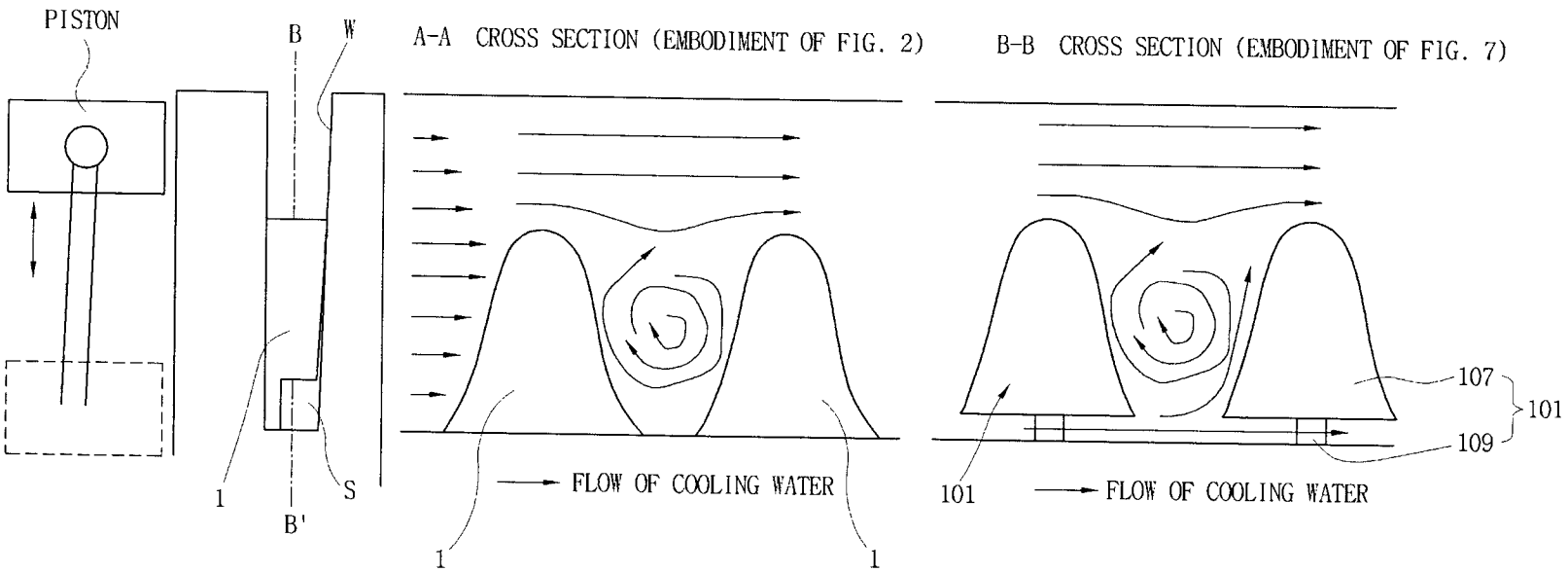
FIG. 8 is a view comparing the flow of cooling water when the inserts for a water jacket of an internal combustion engine of FIG. 6 are disposed with when the inserts of FIG. 1 are disposed.

Referring to FIGS. 6 to 8, a cooling device of an internal combustion engine of this embodiment, is provided with one or more inserts 101 at the lower portion of a water jacket formed at the siamese portion between cylinder bores of a cylinder block in order to increase the flow of cooling water at the upper portion and the lower portion of the water jacket.

Insert 101 has two triangular wings 103 that are symmetrically and integrally connected by a connecting portion 105 at the center. Wing 103 is formed to surround the cylinder of the cylinder block and has a body 107 bent in an arc shape that is the same as the shape of the lower portion of the water jacket and a lower protrusion 109 protruding downward from the lower end of body 107 to contact with the lower side of the water jacket such that the lower end of body 107 is space apart from the lower side of the water jacket.

That is, lower protrusion 109, as shown in FIG. 8, protruding downward from body 107 and contacts with the lower side of the water jacket such that a flow space S of cooling water is formed between body 107 and the lower side of water jacket W. Accordingly, the cooling water smoothly flows through the flow space, which allows effective heat exchange with the engine oil scattered and sticking to the surface of the cylinder block, which forms the flow space to cool the engine oil, such that the engine oil is prevented from be deteriorated and it is not required to additionally provide an oil cooler or increase the capacity to cool the engine oil.

Figure 9:
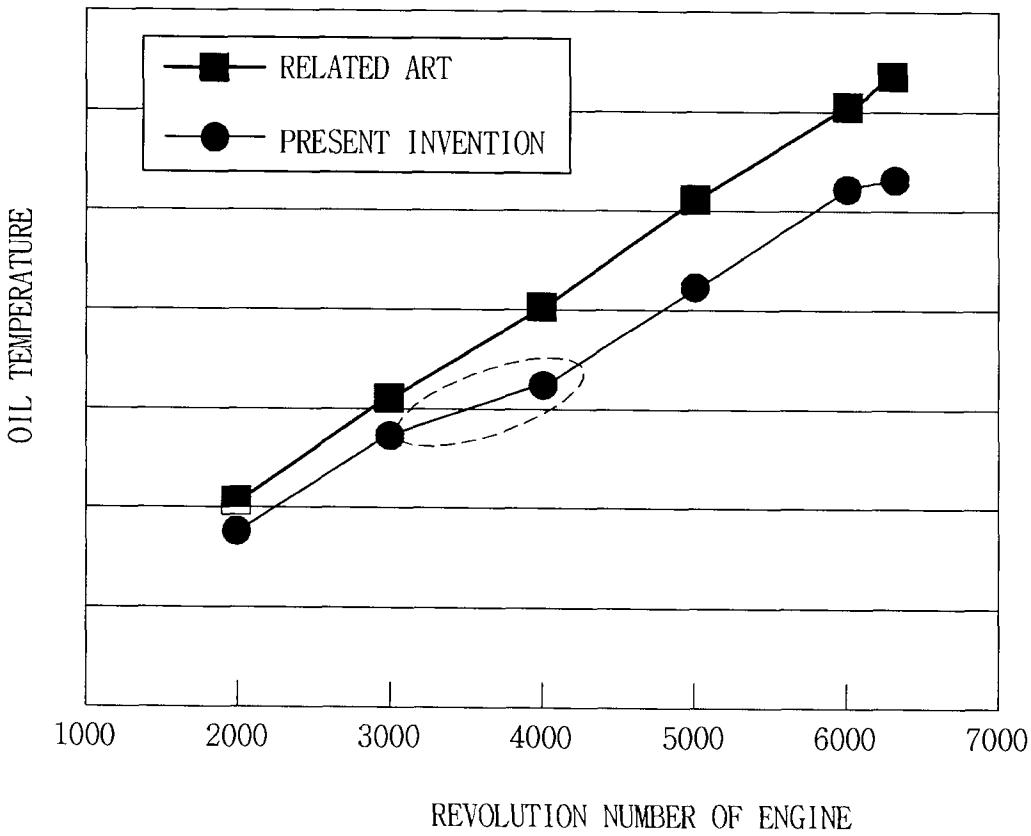
FIG. 9 is a graph showing reduction effect according to the present invention, and comparing a graph of oil temperature according to the revolution number of engine with when an insert is not used in the related art.

For reference, FIG. 9 shows a graph of changes in oil temperature measured according to the revolution numbers of engine that is provided with inserts according to the present invention and an engine that is not provided with an insert in the related art. It can be seen from the graph that it is possible to reduce overall the oil temperature in the engine with the inserts according to the present invention, and particularly, a considerable temperature difference appears at the region of high revolution number.

The flow of cooling water increases above body 107 of the insert as in the first embodiment of the present invention, such that cooling is effectively achieved at the upper portion of the cylinder block and the siamese portion. Further, a space through which the cooling water circulates is formed between adjacent inserts, such that the cooling water cools the portion while swirling. Accordingly, the temperature becomes entirely uniformed in the stroke direction of the piston of the cylinder block and friction of the piston is reduced.

Figure 10:
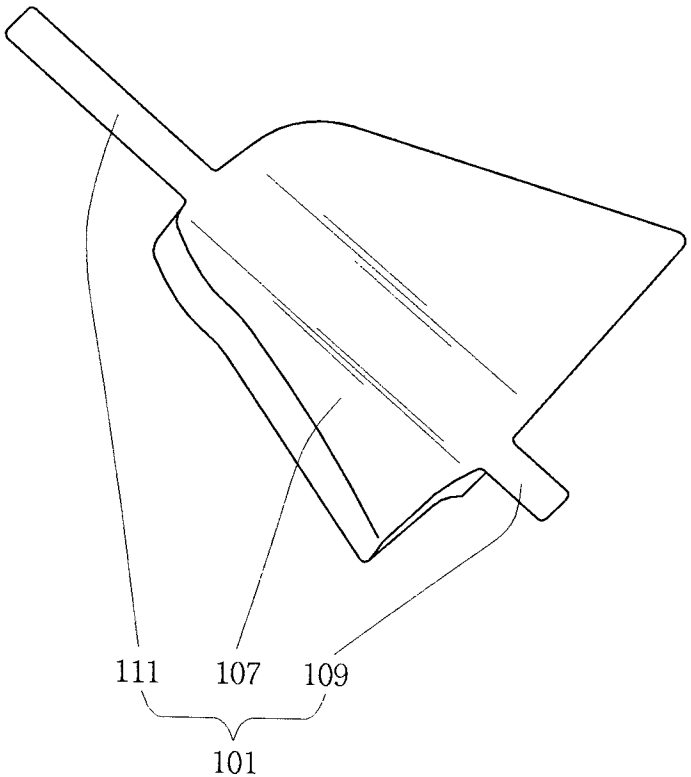
FIG. 10 is a view showing another embodiment of an insert of the present invention.
Figure 11:
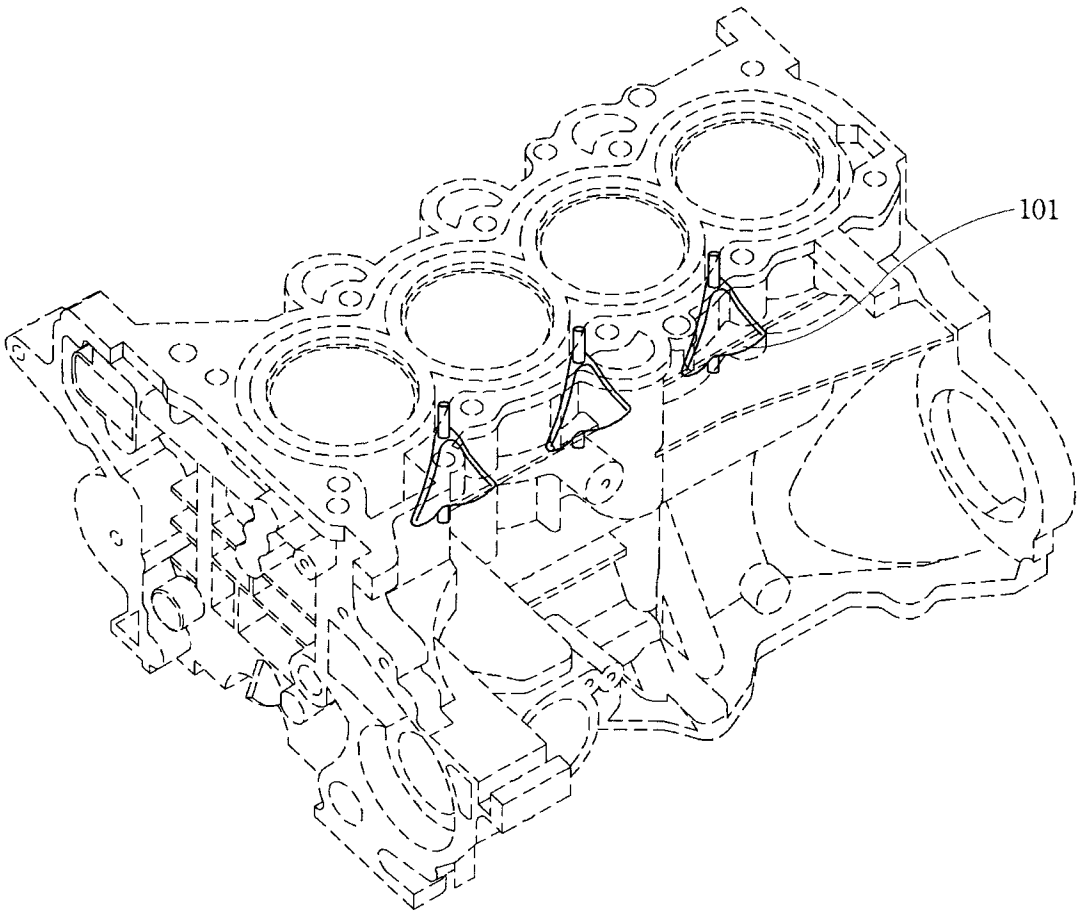
FIG. 11 is a view showing that the insert of FIG. 10 is disposed in a cylinder block.

On the other hand, referring to FIGS. 10 and 11, the insert further has an upper protrusion 111 that protrudes upward from the upper end of body 107 and contacts with the cylinder head such that the position and posture of insert 101 are stably maintained.

Therefore, it is prevented that insert 101 is not firmly fixed to water jacket W and moves in water jacket W, such that it is possible to ensure and maintain smooth and stable cooling performance for the cylinder block by continuously maintaining the stable posture and position of insert 101.

Figure 12:
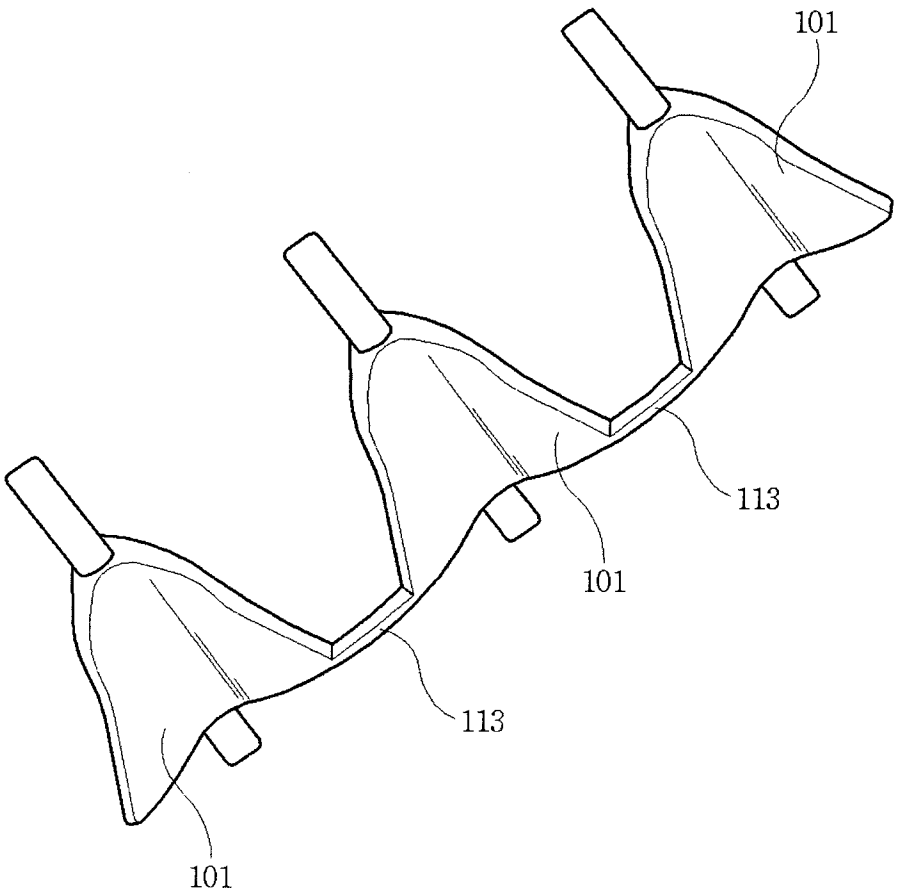
FIG. 12 is a view showing an embodiment when the inserts of the present invention are connected by connecting ribs.

Meanwhile, another embodiment of the present invention is shown in FIG. 12, in which inserts disposed at adjacent siamese portions are integrally connected by connecting ribs 113.

That is, inserts 101 are disposed in a pair to face each other at the siamese portions facing each other. For example, in an internal combustion engine with four cylinders, a pair of insert 101 facing each other is disposed between the first cylinder and the second cylinder, the second cylinder and the third cylinder, and the third cylinder and the fourth cylinder. Further, in inserts 101 disposed as described above, inserts 101 disposed adjacent to each other and easily connected through water jacket W are integrally connected by connecting ribs 113.

Figure 13:
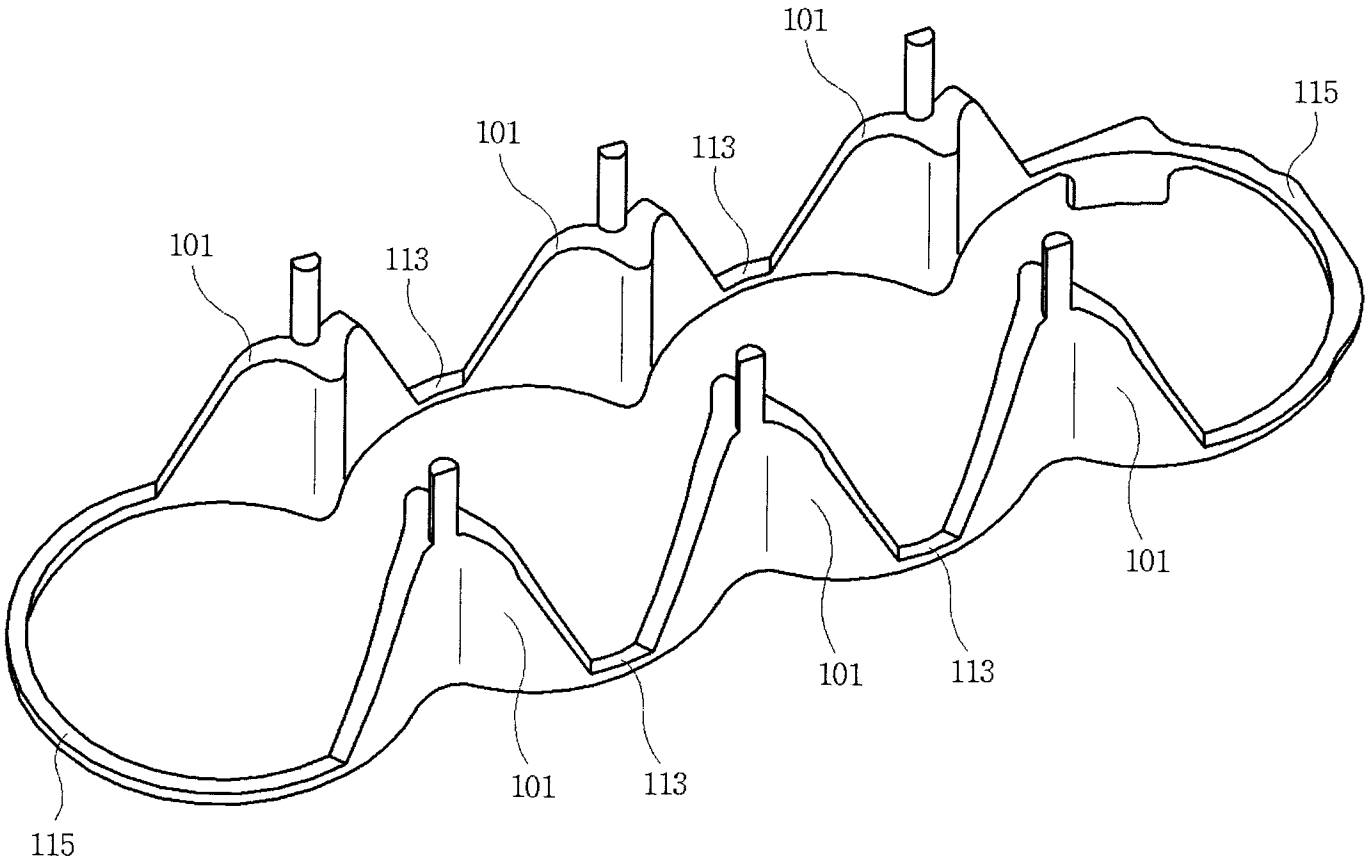
FIG. 13 is a view showing an embodiment when inserts of the present invention are integrally connected by connecting ribs and second connecting ribs.

FIG. 13 shows another embodiment, in which inserts 101 connected by connecting ribs 113 at both sides of cylinder bores arranged in a line are connected by second connecting ribs 115 covering the outsides of the cylinder bores at both ends of the cylinder bores arranged in a line, such that all of inserts 101 that are inserted in one cylinder block are integrally formed.

That is, as shown in FIG. 12, inserts 101, which are integrally connected by connecting ribs 113, are further connected by second connecting ribs 115, such that inserts 101 connected by connecting ribs 113 and second connecting ribs 115 entirely form one ring.

Therefore, it is relatively easy and simple to insert and maintain inserts 101 in water jacket W of the cylinder block, as compared with inserts 101 that are individually separated.

What is claimed is:

1. A cooling device for an internal combustion engine including a cylinder block having cylinder bores and cylinders therein, the cooling device comprising:

one or more inserts that are inserted at a lower portion of a water jacket formed at a siamese portion between the cylinder bores of the cylinder block that increase the flow of cooling water at an upper portion of the water jacket; and wherein the cooling water recirculates between the inserts;

wherein a portion of cooling water simultaneously flows past an upper portion of the inserts and a remainder of the cooling water flows past a lower portion of the inserts so as to cool an overall surface of the water jacket facing an outer circumference of the cylinders.

2. The cooling device for an internal combustion engine as defined in claim 1, wherein the inserts are disposed in pairs facing each other at the siamese portion facing each other.

3. The cooling device for an internal combustion engine as defined in claim 2, wherein, in an internal combustion engine equipped with four cylinders, a pair of said inserts is disposed between a first cylinder and a second cylinder, the second cylinder and a third cylinder, and the third cylinder and a fourth cylinder.

4. A cooling device for an internal combustion engine comprising one or more inserts that are inserted at a lower portion of a water jacket formed at a siamese portion between cylinders and cylinder bores of a cylinder block that increase the flow of cooling water at an upper portion of the water jacket;

wherein a portion of cooling water simultaneously flows past an upper portion of the inserts and a remainder of the cooling water flows past a lower portion of the inserts so as to cool an overall surface of the water jacket facing outer circumferences of the cylinders.

5. The cooling device for an internal combustion engine as defined in claim 4, wherein a space where the cooling water recirculates is formed between adjacent inserts, when a plurality of inserts are provided.

6. The cooling device for an internal combustion engine as defined in claim 5, wherein each of said inserts has a body and a lower protrusion that protrudes downward from a lower side of the body and contacts with a lower side of the water jacket such that the lower side of the body is spaced apart from the lower side of the water jacket.

7. The cooling device for an internal combustion engine as defined in claim 6, wherein each of said inserts further has an upper protrusion that protrudes upward from an upper end of the body and contacts with a cylinder head such that the position and posture of the insert are stably maintained.

8. The cooling device for an internal combustion engine as defined in claim 7, wherein the inserts are disposed in pairs facing each other at siamese portions facing each other.

9. The cooling device for an internal combustion engine as defined in claim 8, wherein one insert is connected with a corresponding insert disposed at an adjacent siamese portion by a connecting rib.

10. The cooling device for an internal combustion engine as defined in claim 8, wherein, in an internal combustion engine equipped with four cylinders, a pair of said inserts are disposed between the first cylinder and the second cylinder, the second cylinder and the third cylinder, and the third cylinder and the fourth cylinder.

11. An insert for a water jacket of an internal combustion engine, wherein two triangular wings are symmetrically and integrally connected by a central connecting portion and each of the wings is bent in an arch shape that is the same as a lower shape of a water jacket formed in a shape surrounding a cylinder of a cylinder block;

wherein a portion of cooling water simultaneously flows through an upper portion of the insert and a remainder of the cooling water flows through an lower portion of the insert so as to cool an overall surface of the water jacket facing the outer circumference of cylinders.

12. The insert for a water jacket of an internal combustion engine as defined in claim 11, the wings and the connecting portion are formed by injection-molding a plastic material.

13. The insert for a water jacket of an internal combustion engine as defined in claim 11, wherein the insert has:

a body having the two triangular wings connected symmetrically and integrally by the connecting portion of the center portion, in which the wing is formed in a shape surrounding the cylinder of the cylinder block and bent in an arc shape that is the same as the lower shape of the water jacket; and a lower protrusion that protrudes downward from a lower end of the body and contacts with a lower side of the water jacket such that the lower end of the body is spaced apart from the lower side of the water jacket.

14. The insert for a water jacket of an internal combustion engine as defined in claim 13, wherein the body further has an upper protrusion that protrudes upward from an upper end of the body and contacts with a cylinder head of the internal combustion engine such that the position and posture of the insert are stably maintained.

15. The insert for a water jacket of an internal combustion engine as defined in claim 13, wherein the insert is integrally connected with a corresponding insert disposed at an adjacent siamese portion by a connecting rib.

16. The insert for a water jacket of an internal combustion engine as defined in claim 13, wherein the insert is connected to a plurality of corresponding inserts by respective connecting ribs on one of opposing sides of cylinder bores arranged in a line and connected by second connecting ribs encircling end circumferences of the cylinder bores at both ends of the cylinder bores arranged in a line, such that all of the inserts that are inserted in the cylinder block are integrally formed.

17. The insert for a water jacket of an internal combustion engine as defined in claim 16, wherein the inserts connected by the connecting ribs and the second connecting ribs entirely form one ring.

* * * * *